US007892054B2

(12) United States Patent
Fukuoka

(10) Patent No.: US 7,892,054 B2
(45) Date of Patent: Feb. 22, 2011

(54) OUTBOARD MOTOR

(75) Inventor: Yoshihito Fukuoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 165 days.

(21) Appl. No.: 12/339,181

(22) Filed: Dec. 19, 2008

(65) Prior Publication Data

US 2009/0163094 A1 Jun. 25, 2009

(30) Foreign Application Priority Data

Dec. 20, 2007 (JP) ..... 2007-328291

(51) Int. Cl.
*F02N 1/00* (2006.01)

(52) U.S. Cl. ..... 440/88 P

(58) Field of Classification Search ..... 440/75, 440/88 P, 88 L, 88 R
See application file for complete search history.

(56) References Cited

U.S. PATENT DOCUMENTS 2,246,206 A * 6/1941 Herrington ..... 440/88 R
2,644,474 A * 7/1953 Houchin ..... 134/166 R
3,025,824 A * 3/1962 Foster ..... 440/75

FOREIGN PATENT DOCUMENTS

JP 3509171 B2 3/2004

OTHER PUBLICATIONS

Fukuoka; "Outboard Motor"; U.S. Appl. No. 12/339,192, filed Dec. 19, 2008.

* cited by examiner

*Primary Examiner*—Daniel V Venne
(74) *Attorney, Agent, or Firm*—Keating & Bennett, LLP

(57) ABSTRACT

An outboard motor includes a water pump arranged to draw in cooling water, a pump drive mechanism that decelerates rotation of a drive shaft and transmits the rotation to the water pump, and an oil supply device (a main oil passage, oil ejection passages, a hollow portion, and an oil ejection hole) arranged to supply oil to lubricate a transmission to the pump drive mechanism. The outboard motor is able to prevent occurrence of cavitation in a water pump of a vane-type pump and to increase a discharge amount of the pump while an engine is running at high speed.

10 Claims, 10 Drawing Sheets

OUTBOARD MOTOR

BACKGROUND OF THE INVENTION

1. Field of the Invention

The present invention relates to an outboard motor provided with a water pump arranged to draw in cooling water.

2. Description of the Related Art

In a conventional outboard motor, outside water is drawn in by a water pump to be used as cooling water for an engine. A vane-type water pump is commonly used in which an impeller formed with a flexible material such as rubber is eccentrically rotated in a cylindrical pump housing so as to avoid negative influences of sand, impurities and the like that are frequently contained in the outside water.

In a conventional outboard motor, the water pump is disposed near a midsection of a drive shaft that transmits engine output to a propeller. The water pump is directly driven by the drive shaft (see JP-B-3509171).

However, as described above, since the water pump is directly driven by the drive shaft which rotates at the same speed as the engine, the rotational speed of the water pump becomes equal to that of the engine. Thus, when an outer diameter of the impeller is large, a speed at the tip of an impeller blade becomes excessively high at an engine speed of about 6,000 rpm, which is close to the maximum engine speed. Consequently, it causes cavitation in the pump housing and a plateau in the fluid discharge amount.

SUMMARY OF THE INVENTION

In order to overcome the problems described above, preferred embodiments of the present invention provide an outboard motor with a simple, compact, and highly reliable configuration, which can minimize the occurrence of cavitation in a vane-type water pump at a high engine speed and can increase the discharge amount of the pump.

In order to solve the above problems, a first preferred embodiment of the present invention preferably provides an outboard motor including an engine with a vertically-positioned crankshaft which is mounted above a casing, a drive shaft arranged to transmit rotation of the crankshaft to a propeller shaft pivotally supported in a lower portion of the casing, a water pump arranged to draw in cooling water, and a pump drive mechanism arranged to decelerate a rotation from the drive shaft and then transmit the decelerated rotation to the water pump.

In addition to the configuration described in the first preferred embodiment, a second preferred embodiment of the present invention provides an outboard motor in which the pump drive mechanism preferably takes power in a direction perpendicular or substantially perpendicular to an axial direction of the drive shaft and then transmits the power to the water pump.

In addition to the configuration described in the first or second preferred embodiment, a third preferred embodiment of the present invention provides an outboard motor in which the pump drive mechanism is preferably disposed in the proximity of a transmission which is mounted on the drive shaft and which is provided with an oil supply device arranged to supplying oil that lubricates the transmission of the pump drive mechanism.

In addition to the configuration described in the third preferred embodiment, a fourth preferred embodiment of the present invention provides an outboard motor in which the oil supply device preferably supplies the oil to each lubricated section of the pump drive mechanism through an oil passage defined in an axis of the drive shaft.

In addition to the configuration described in any one of the first to fourth preferred embodiments, a fifth preferred embodiment of the present invention provides an outboard motor in which the pump drive mechanism decelerates the rotation of the drive shaft through a spur gear mechanism and transmits the decelerated rotation of the drive shaft to the water pump.

In addition to the configuration described in any one of the first to fourth preferred embodiments, a sixth preferred embodiment of the present invention provides an outboard motor in which the pump drive mechanism decelerates the rotation of the drive shaft through a bevel gear mechanism and transmits the decelerated rotation of the drive shaft to the water pump.

In addition to the configuration described in any one of the first to fourth preferred embodiments, a seventh preferred embodiment of the present invention provides an outboard motor in which the pump drive mechanism decelerates the rotation of the drive shaft through a screw gear mechanism and transmits the decelerated rotation of the drive shaft to the water pump.

In addition to the configuration described in any one of the first to fourth preferred embodiments, an eighth preferred embodiment of the present invention provides an outboard motor in which the pump drive mechanism decelerates the rotation of the drive shaft through a chain drive mechanism and transmits the decelerated rotation of the drive shaft to the water pump.

In addition to the configuration described in any one of the first to fourth preferred embodiments, a ninth preferred embodiment of the present invention provides an outboard motor in which the pump drive mechanism transmits output of the drive shaft to the water pump through a plurality of power transmission mechanisms.

According to the first preferred embodiment of the present invention, since the engine speed is reduced to an appropriate speed by the pump drive mechanism and then transmitted to the water pump, it is possible to prevent an occurrence of cavitation in the vane-type water pump and also possible to increase the fluid discharge amount of the pump.

According to the second preferred embodiment of the present invention, since the water pump is spaced away from the drive shaft, the size of a housing structure around the drive shaft can be reduced.

According to the third preferred embodiment of the present invention, due to its simple and compact structure, the pump drive mechanism can be appropriately lubricated to increase reliability.

According to the fourth preferred embodiment of the present invention, since there is no need to add new parts to construct the oil supply device that lubricates the pump drive shaft, the oil supply device can have a simple structure.

According to the fifth to the eighth preferred embodiments of the present invention, a layout around the water pump and the pump drive mechanism can be improved and reduced in size by arranging the pump drive mechanism in a configuration that is suited for an internal layout of the outboard motor.

According to the ninth preferred embodiment of the present invention, since the water pump and the pump drive mechanism can be mounted in a manner where their configurations are the most suited to the internal layout of the outboard motor, they can substantially contribute to the improvement in the layout and size reduction.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

A preferred embodiment of the present invention will hereinafter be described with reference to FIG. 1 through FIG. 6.

Figure 1:
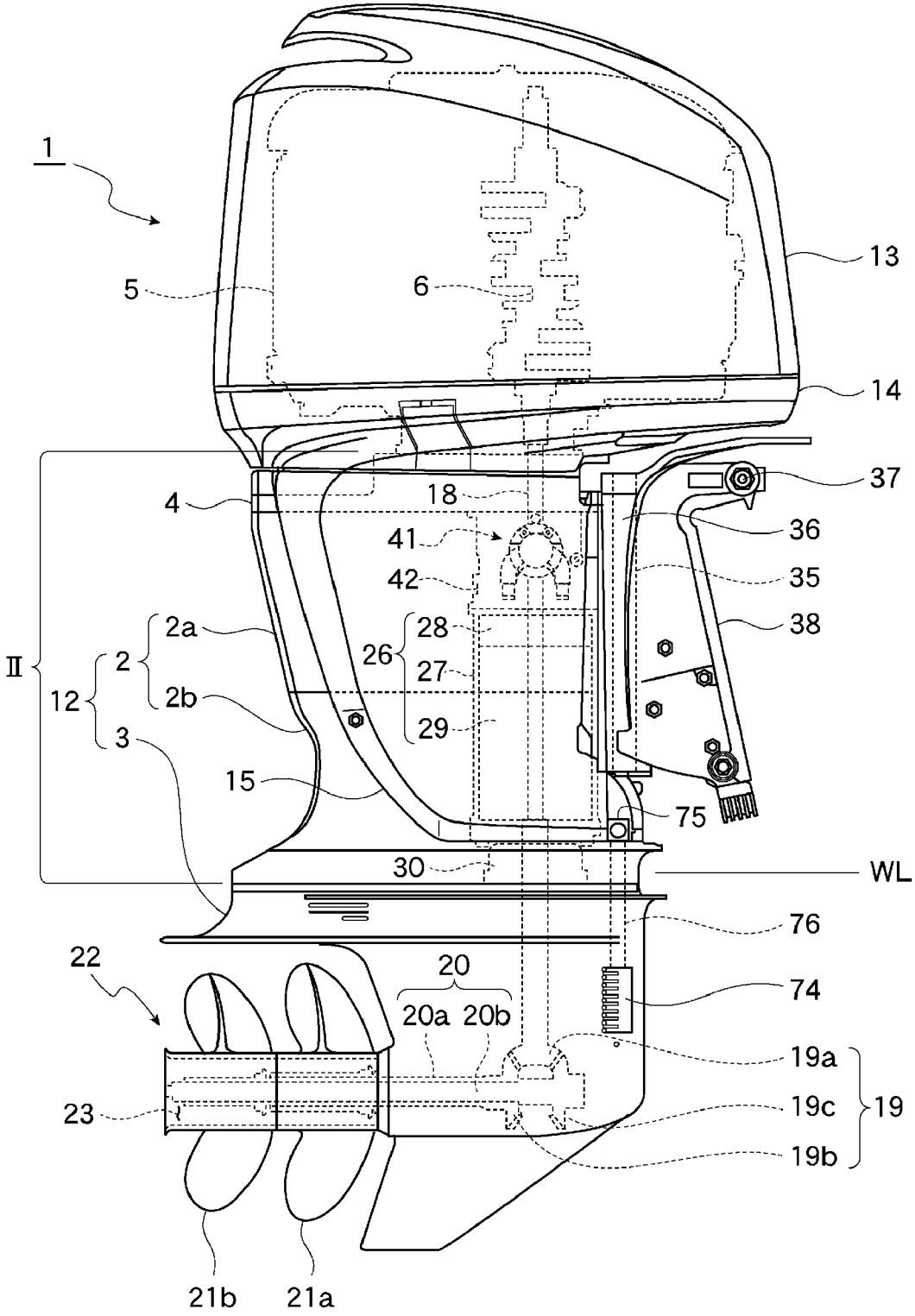
FIG. 1 is a right side view showing an outboard motor according to a preferred embodiment of the present invention.
Figure 2:
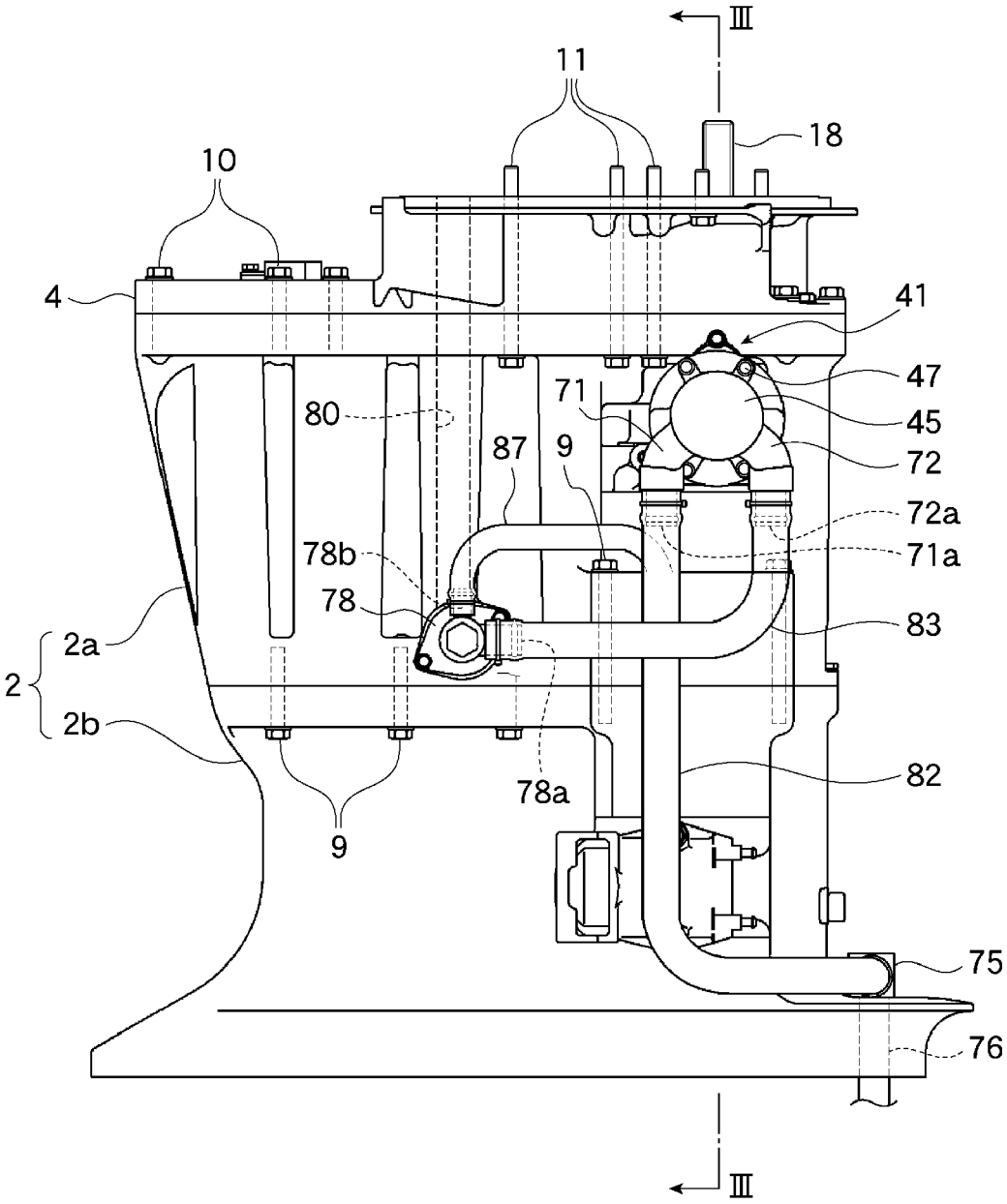
FIG. 2 is an enlarged view of a section II in FIG. 1.
Figure 3:
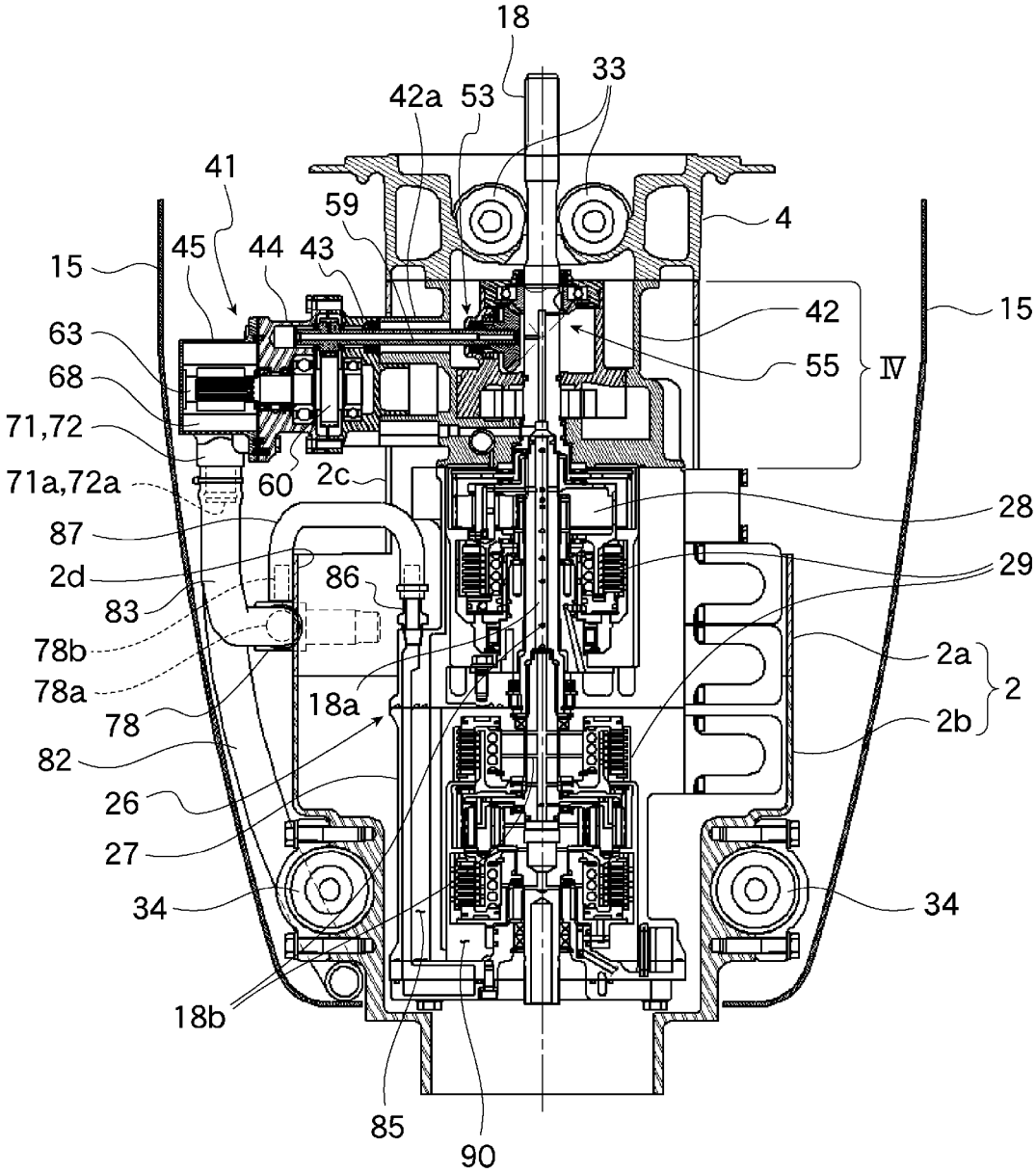
FIG. 3 is a vertical sectional view taken along the line III-III in FIG. 2.

FIG. 1 is a right side view showing a preferred embodiment of an outboard motor according to the present invention. FIG. 2 is an enlarged view of a section II in FIG. 1. FIG. 3 is a vertical sectional view taken along the line III-III in FIG. 2.

In an outboard motor 1, a lower casing 3 is disposed below an upper casing 2, and an engine 5 is mounted on top of the upper casing 2 through a generally flat mounting plate 4. The engine 5 is preferably a water-cooled V6 engine, for example, and is arranged on the mounting plate 4 in a manner where a crankshaft 6 thereof extends in a vertical position.

For example, the upper casing 2 uses a horizontally split structure in which an upside casing 2*a* and a downside casing 2*b* are fastened to each other with a plurality of fixing bolts 9, for example. The mounting plate 4 can be fixed to an upper surface of the upside casing 2*a* with a plurality of fixing bolts 10 and through bolts 11. The lower casing 3 can be fixed to a lower surface of the downside casing 2*b* with a fixing bolt, which is not shown. The upper casing 2 and the lower casing 3 then define the casing 12. The through bolt 11 is inserted from below an upper flange of the upside casing 2*a* through the mounting plate 4 and then tightened to the engine 5 to fasten the three members 2*a*, 4, 5.

The engine 5 is covered with a detachable upper cover 13 and a detachable lower cover 14. A right side surface and a left side surface of the upper casing 2 are covered with a side cover 15, which is also detachable. Here, FIG. 2 shows a condition where the side cover 15 is removed.

A drive shaft 18 is vertically supported in the casing 12. The drive shaft 18 is axially divided into multiple stages, and a top end thereof is spline-fitted to a bottom end of the crankshaft 6. A bottom end of the drive shaft 18 reaches the inside of the lower casing 3 and is coupled to a propeller shaft 20, which is horizontally supported in the lower casing 3, via a bevel gear mechanism 19. A transmission 26, which is later described, is mounted to a midsection of the drive shaft 18.

The propeller shaft 20 is preferably a double-rotary shaft that coaxially combines an outer shaft 20*a* with an inner shaft 20*b*. A drive bevel gear 19*a* of the bevel gear mechanism 19 rotates as a unit with the drive shaft 18, a driven bevel gear 19*b* rotates as a unit with the outer shaft 20*a*, and a driven bevel gear 19*c* rotates as a unit with an inner shaft 20*b*. A first propeller 21*a* is fixed to the outer shaft 20*a*, and a second propeller 21*b* is fixed to the inner shaft 20*b*. These propellers make up a contra-rotating propeller mechanism 22. An exhaust passage 23 is arranged along the axes of the first propeller 21*a* and the second propeller 21*b*.

The transmission 26 is provided in the casing 12 (the upper casing 2). The transmission 26 is mounted on the drive shaft 18 and houses an automatic gear change system 29 that includes a planetary gear train 28 and a forward/reverse switch in a transmission case 27 that makes up an outer shell of the transmission 26. An intermediate reduction gear 30 is located immediately below the transmission 26 (see FIG. 1).

When the engine 5 is started, rotation of the crankshaft 6 is transmitted to rotate the drive shaft 18. The rotational speed of the drive shaft 18 is first shifted in the transmission 26, and a rotational direction of the drive shaft 18 is switched to a forward or reverse direction. Next, the rotation of the drive shaft 18 is decelerated by the intermediate reduction gear 30 and the bevel gear mechanism 19 and is transmitted to the propeller shaft 20. Then, the outer shaft 20*a* of the propeller shaft 20 and the propeller 21*a* rotate in an opposite direction from the inner shaft 20*b* and the second propeller 21*b* to produce a high propulsive force.

As shown in FIG. 3, a steering bracket (not shown) is coupled and secured to a front section of the outboard motor 1 through a pair of right and left upper mounts 33 embedded in the mounting plate 4 and a pair of right and left lower mounts 34 respectively provided on a right and a left sidewall of the downside casing 2*b* of the upper casing 2. The steering bracket is coupled to a swivel bracket 36 by a vertical steering shaft 35 shown in FIG. 1. The swivel bracket 36 is coupled to a clamp bracket 38 through a horizontal swivel shaft 37 and a lock mechanism (not shown). The clamp bracket 38 is secured to a transom of the watercraft.

The outboard motor 1 can steer the watercraft by pivoting to the right and left about the steering shaft 35, and can also be tilted up above the water surface by pivoting vertically about the swivel shaft 37.

Figure 4:
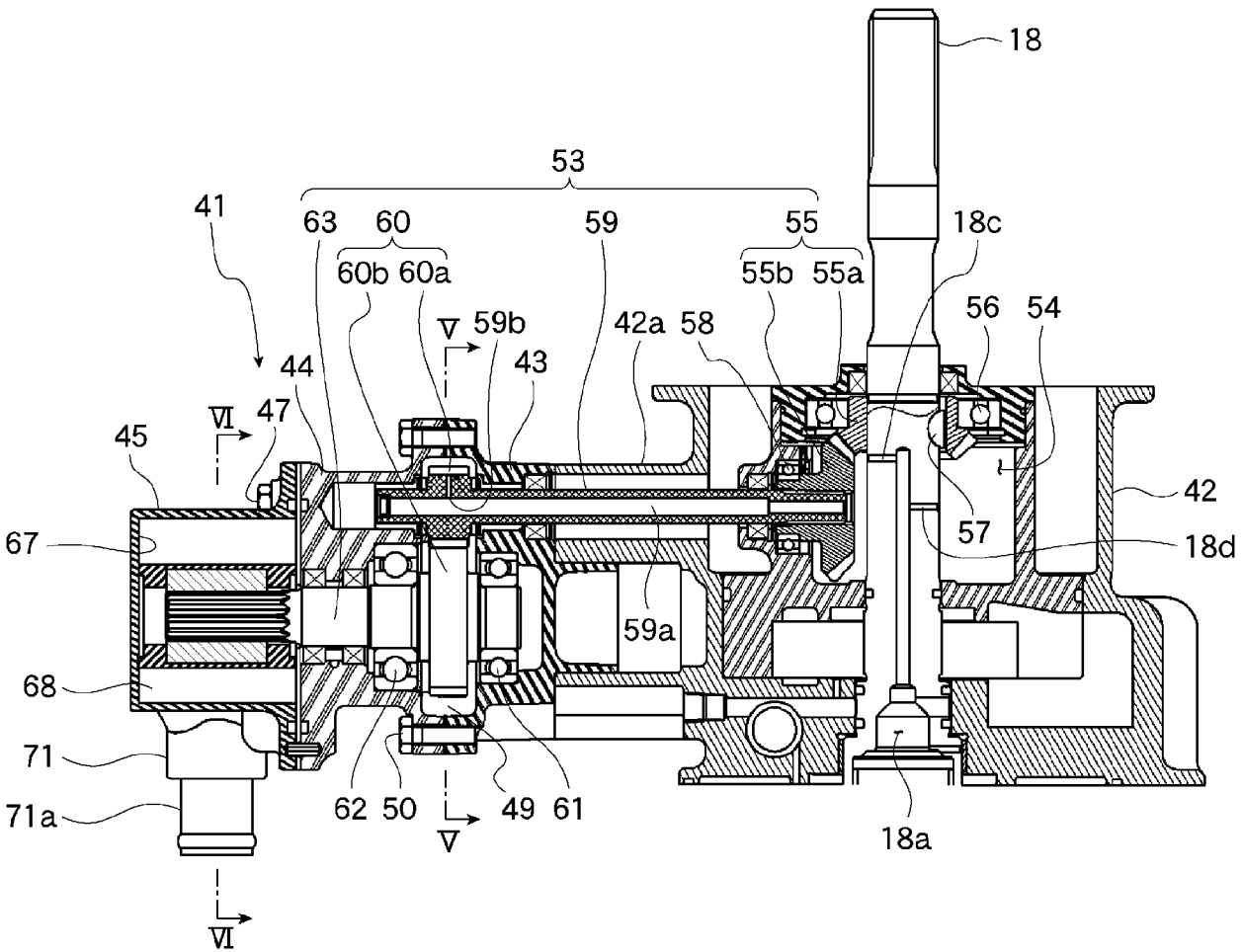
FIG. 4 is a vertical sectional view of an enlarged section IV in FIG. 3.
Figure 5:
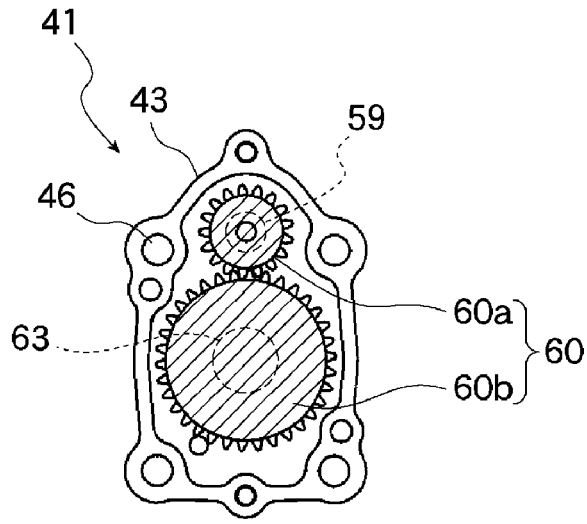
FIG. 5 is a vertical sectional view taken along the line V-V in FIG. 4.
Figure 6:
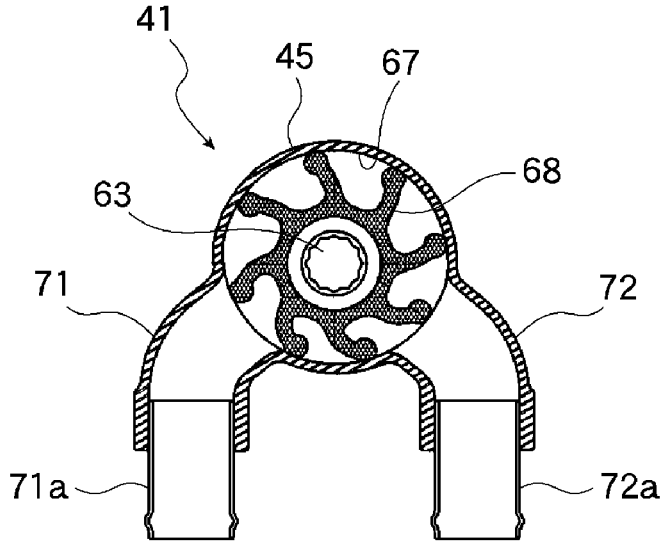
FIG. 6 is a vertical sectional view taken along the line VI-VI in FIG. 4.

As shown in FIGS. 4 to 6, a water pump 41 arranged to draw in cooling water for the engine 5 is disposed on an outer surface of the casing 12, or on a right side surface of the upper casing 2 in a traveling direction of the watercraft, for example. An installation position of the water pump 41 is higher than that of the transmission 26 and is also sufficiently higher than a waterline WL during operation of the outboard motor 1 (see FIG. 1). Here, the water pump 41 is displaced in FIG. 2 for a better understanding of the configuration.

A separate pump mounting case 42 is in close contact with and fixed to an upper surface of the transmission case 27 of the transmission 26 that is disposed in the upper casing 2. An upper surface of the pump mounting case 42 is in close contact with and fixed to a lower surface of the mounting plate 4.

An extension 42*a* that extends horizontally to the right is integrally formed with a right side surface of the pump mounting case 42. Meanwhile, on a right side surface of the upper casing 2*a* that defines the upper case 2, a pump opening 2*c* is provided in a portion in the proximity of a right side of the pump mounting case 42 (see FIG. 3). The extension 42*a* of the pump mounting case 42 projects outward to the right from the pump opening 2*c*. The pump opening 2*c* is arranged in a step-like pocket shape, which also opens downward.

An inner gear housing 43, an outer gear housing 44, and a pump housing 45 are attached to the extension 42*a* in a water-tight manner such that each serially overlaps with another on its right. These three members 43, 44, 45 and the extension 42*a* define a major portion of the water pump 41. As shown in FIG. 5, a pump fixing bolt 47 (see FIGS. 2 and 4) penetrates through a bolt hole 46 that is provided through each of four corners of the above three members 43, 44, 45. The pump fixing bolt 47 is then tightened to the extension 42*a* so as to fasten the three members 43, 44, 45 to the extension 42*a*.

As described above, each of the inner gear housing 43, the outer gear housing 44, and the pump housing 45, which define the main portion of the water pump 41, project outward from the pump opening 2*c* provided in the upper casing 2. Thus, the above three members 43, 44, 45 can easily be removed from the outside of the upper casing 2 simply by unscrewing the pump fixing bolt 47 from the outside.

A reduction gear chamber 49 is defined in a water-tight state between the inner gear housing 43 and the outer gear housing 44. The gear housings 43, 44 are fastened with two assembly bolts 50 that are preferably exclusive for this use and are different from the pump fixing bolt 47, which is described above.

The water pump 41 is driven by the rotation of the drive shaft 18 that is decelerated and then transmitted to the water pump 41 by a pump drive mechanism 53 preferably having a bevel gear mechanism and a reduction gear mechanism.

The pump drive mechanism 53 is provided in the proximity of the transmission 26, for example, from the pump mounting case 42 (the extension 42*a*) to the inside of the water pump 41. The pump drive mechanism 53 is also configured as follows so that it takes power in a direction perpendicular or generally perpendicular to the axial direction of the drive shaft 18, such as in a right direction, to transmit the power to the water pump 41.

A pump power take-off chamber 54 is defined inside the pump mounting case 42 and houses a bevel gear mechanism 55. The bevel gear mechanism 55 includes a drive bevel gear 55*a* and a driven bevel gear 55*b*. The drive bevel gear 55*a* is rotatably supported in a pump mounting case 42 by a bearing 56 so as to rotate as a unit with the drive shaft 18 by a woodruff key 57. The driven bevel gear 55*b* is rotatably supported by a bearing 58 and meshes with the drive bevel gear 55*a*. A gear ratio of the bevel gear mechanism 55 is set at 1:1, for example.

A hollow pump drive shaft 59 that follows a width direction of the outboard motor 1 penetrates from the extension 42*a* to the insides of the inner and the outer gear housings 43, 44. The pump drive shaft 59, at its left end, is coupled to the driven bevel gear 55*b* for unitary rotation therewith by spline-fitting and the like. A hollow portion 59*a* is arranged along the axis of the pump drive shaft 59.

A reduction gear mechanism 60 (a spur gear mechanism) is housed in the reduction gear chamber 49. The reduction gear mechanism 60 includes a reduction drive gear 60*a* and a reduction driven gear 60*b* that meshes with the reduction drive gear 60*a*. These gears 60*a*, 60*b* may be helical gears, for example, and a gear ratio is approximately about 1:1.5 to about 1:2.

While the reduction drive gear 60*a* is integrally formed with the pump drive shaft 59 near the right end thereof, the reduction driven gear 60*b* is integrally formed with an impeller shaft 63. The impeller shaft 63 is pivotally supported by a bearing 61 disposed in the inner gear housing 43 and also by a bearing 62 disposed in the outer gear housing 44. The rotation of the pump drive shaft 59 is decelerated to approximately about 1/1.5 to about 1/2 by the reduction gear mechanism 60 and then transmitted to the impeller shaft 63.

The pump drive mechanism 53 includes a plurality of power transmission mechanisms, namely the bevel gear mechanism 55 and the reduction gear mechanism 60 as described above, and further includes the pump drive shaft 59 and the impeller shaft 63. However, the pump drive mechanism 53 is not limited to the above configuration and may use any other suitable drive system.

A right end of the impeller shaft 63 eccentrically passes through the inside of an impeller chamber 67 in the pump housing 45, and is provided with an impeller 68 at a free end for unitary rotation therewith such as by spline-fitting. The impeller 68 is preferably made of an elastic material such as, for example, rubber and urethane, and is arranged in a water wheel shape with eight blades, for example. The impeller shaft 63 and the impeller 68 are eccentric with respect to an axis of the impeller chamber 67, and side surfaces and blade tips of the impeller 68 respectively contact the right and left side surfaces and an inner periphery of the impeller chamber 67. Accordingly, the water pump 41 is configured as a vane-type pump.

An intake port 71 and a discharge port 72 are provided on a periphery of the pump housing 45 in which the impeller 68 is housed. The intake port 71 and the discharge port 72 are respectively provided with an intake union 71*a* and a discharge union 72*a*. The intake port 71 (the intake union 71*a*) and the discharge port 72 (the discharge union 72*a*) are both directed downward.

As shown in FIG. 1, an intake hole 74 is provided on an outer surface of the lower casing 3, and as also shown in FIG. 2, a connecting union 75 is provided above a front end of the lower casing 3. An intake conduit 76 is disposed in the lower casing 3 such that it extends upward from the intake hole 74 and is connected to the connecting union 75.

As shown in FIGS. 2 and 3, a cooling water branch section 78 in a trifurcated passage shape is provided on the right side surface of the upper casing 2 (the upside casing 2*a*). The cooling water branch section 78 includes a thick inlet union 78*a* extending to the front of the motor body, and a thin branch union 78*b* extending upward. Also, a cooling water supply passage 80 is provided in the upside casing 2*a* and the mounting plate 4 such that it is elevated from a mounting portion of the cooling water branch section 78 to supply cooling water to the engine 5.

A flexible cooling water intake hose 82 connects the connecting union 75 of the lower casing 3 to the intake union 71*a* of the water pump 41. A flexible cooling water discharge hose 83 connects the discharge union 72*a* of the water pump 41 to the inlet union 78*a* of the cooling water branch section 78.

As shown in FIG. 3, a water jacket 85 is arranged in the transmission case 27 of the transmission 26, and a cooling water introducing union 86 that is in communication with the water jacket 85 is provided in a right side surface of the transmission case 27. A flexible cooling water branch hose 87 connects the branch union 78*b* of the cooling water branch section 78 to the cooling water introducing union 86. The cooling water branch hose 87 is arranged to enter the upper casing 2 from the outside across an outer edge 2*d* of the pump opening 2*c* in the step-like pocket shape.

Bore diameters of the cooling water intake hose 82 and the cooling water discharge hose 83 are larger than a bore diameter of the cooling water branch hose 87. Such a difference in the bore diameters is determined by a volume ratio of cooling water delivered to a water jacket of the engine 5 to cooling water delivered to the water jacket 85 of the transmission 26.

The cooling water intake hose 82, the cooling water discharge hose 83, and the cooling water branch hose 87 along with the water pump 41 and the pump opening 2*c* are covered with the side cover 15. Thus, these members 82, 83, 87, 41, 2*c* are not exposed to the exterior of the outboard motor 1.

As shown in FIG. 3, an oil reservoir 90 is provided at the bottom of the transmission 26, and a certain amount of oil is reserved therein. An oil supply device is provided to supply oil for lubricating the transmission 26 to the pump drive mechanism 53. The oil supply device is preferably configured as described below.

As shown in FIGS. 3 and 4, the axis of the drive shaft 18 is provided with a main oil passage 18*a* that extends in the axial direction. When the drive shaft 18 starts rotating along with the activation of the engine 5, an oil pump (not shown), which is provided in the transmission 26, draws oil into the oil reservoir 90 and delivers it with pressure to the main oil passage 18*a*.

A section of the main oil passage 18*a* that passes through the transmission 26 includes a plurality of branch oil passages 18*b* that branch off from the main oil passage 18*a* and extend in a radial direction of the drive shaft 18 (see FIG. 3). The oil is supplied from these branch oil passages 18*b* to each lubricated section of the planetary gear train 28 and of the automatic gear change system 29.

In addition, as shown in FIG. 4, oil ejection passages 18*c*, 18*d* are arranged to extend in the radial direction of the drive shaft 18 from the vicinity of the upper end of the main oil passage 18*a*. The oil ejection passage 18*c* is located as high as a meshing portion of the drive bevel gear 55*a* with the driven bevel gear 55*b* of the bevel gear mechanism 55. The oil ejection passage 18*d* is located as high as the hollow portion 59*a* of the pump drive shaft 59. Also, in the hollow portion 59*a* of the pump drive shaft 59, an oil ejection hole 59*b* is arranged to extend in a radial direction of the pump drive shaft 59 in accordance with the position of the reduction drive gear 60*a*.

The oil supply device is configured to include the main oil passage 18*a*, the oil ejection passages 18*c*, 18*d*, the hollow portion 59*a*, and the oil ejection hole 59*b*.

When the engine 5 of the outboard motor 1 configured as described above is activated, the rotation of the drive shaft 18 is transmitted to the pump drive shaft 59 at a constant speed by the bevel gear mechanism 55 with a gear ratio set at 1:1. Then, rotation of the pump drive shaft 59 is decelerated to approximately 1/1.5 to approximately 1/2 by the reduction gear mechanism 60 with its gear ratio set at approximately 1:1.5 to approximately 1:2, and is transmitted to the impeller shaft 63 and the impeller 68. The impeller 68 rotates clockwise as seen in FIG. 6.

When the impeller 68 is rotated in the impeller chamber 67 of the pump housing 45, outside water is taken in through the intake hole 74 due to negative pressure produced in the intake port 71. Prior to being supplied as cooling water to a water jacket (not shown) arranged in the engine 5 the water flows through in the following order: the intake hole 74→the intake conduit 76→the connecting union 75→the cooling water intake hose 82→the water pump 41→the cooling water discharge hose 83→the cooling water branch section 78→the cooling water supply passage 80. In addition, a portion of the cooling water is branched off at the cooling water branch section 78 and then supplied to the water jacket 85 in the transmission 26 through the cooling water branch hose 87.

The cooling water that has cooled the engine 5 and the transmission 26 is discharged to the outside water together with exhaust gases via an expansion chamber (not shown) arranged in the casing 12 and also via the exhaust passage 23 arranged along the axes of the first propeller 21*a* and the second propeller 21*b*.

The oil stored in the oil reservoir of the transmission 26 travels through the main oil passage 18*a* in the drive shaft 18 and is ejected from the oil ejection passages 18*c*, 18*d*. The oil ejected from the oil ejection passage 18*c* is disseminated to a meshing portion between the drive bevel gear 55*a* and the driven bevel gear 55*b* to lubricate the bevel gear mechanism 55. The oil ejected from the oil ejection passage 18*d* enters the hollow portion 59*a* of the pump drive shaft 59, is ejected from the oil ejection hole 59*b* that lies ahead, and is disseminated to the meshing portion of the reduction drive gear 60*a* with the reduction driven gear 60*b* to lubricate the reduction gear mechanism 60.

In the outboard motor 1, the rotational speed of the drive shaft 18 is decelerated to approximately 1/1.5 to approximately 1/2 by the pump drive mechanism 53 and then transmitted to the impeller shaft 63. Thus, even when the speed of the engine 5 reaches approximately 6,000 rpm which is near the maximum engine speed, the rotational speed of the impeller 68 can be retained at approximately 3,000 rpm to approximately 4,000 rpm.

Accordingly, it is possible to effectively prevent the occurrence of cavitation caused by excessively high speed at the tips of the impeller 68 in the water pump 41 of the vane-type pump. It is also possible to prevent the discharge amount of the water pump 41 from reaching a plateau. The reduction ratio of the water pump 41 can be freely set by changing the gear ratios of the bevel gear mechanism 55 and the reduction gear mechanism 60.

In addition, the outboard motor 1 uses a configuration in which the pump drive mechanism 53 is disposed near the transmission 26 and in which oil for lubricating each section in the transmission 26 is guided by the oil supply device, namely the main oil passage 18*a*, the oil ejection passages 18*c*, 18*d*, the hollow portion 59*a*, and the oil ejection 59*b*, to the pump drive mechanism 53 to lubricate the bevel gear mechanism 55 and the reduction gear mechanism 60. Thus, there is no need to provide an additional lubricating device or complicated lubrication passages. Accordingly, the outboard motor 1 has a simple, compact, and highly reliable lubricating structure.

Meanwhile, the pump drive mechanism 53 is configured such that it takes power in the direction perpendicular or generally perpendicular to the axial direction of the drive shaft 18 and transmits it to the water pump 41. Thus, the water pump 41 that has been limited in its mounting position near or on the drive shaft 18 so far can now be mounted away from the drive shaft 18. Accordingly, in addition to the layout of the water pump 41, the layout of the piping (82, 83, 87, etc.) around the water pump 41 can be dramatically improved. Furthermore, it is possible to downsize the structure of the casing 12 (the shape of the upper casing 2, etc.) around the drive shaft 18.

Moreover, the pump drive mechanism 53 is configured such that it transmits the output of the drive shaft 18 to the water pump 41 through a plurality of the power transmission mechanisms (the bevel gear mechanism 55 and the reduction gear mechanism 60 in this preferred embodiment). Thus, the water pump 41 and the pump drive mechanism 53 are mounted such that their configurations are the most suited for the internal layout of the outboard motor 1. Accordingly, they can substantially contribute to an improvement in the layout and downsizing of the outboard motor 1.

Here, a plurality of the power transmission mechanisms included in the pump drive mechanism 53 need not necessarily be different types. For example, a multi-step spur gear mechanism may be provided. Or, bevel gear mechanisms may be provided at both ends of the pump drive shaft 59.

The impeller 68 of the water pump 41 is a part that requires periodic replacement, however, in this preferred embodiment, there is no need raise the watercraft out of the water each time the impeller 68 needs to be replaced. This is because the pump housing 45, which houses the impeller 68, is arranged to project outward from the pump opening 2*c* of the upper casing 2, and also because the installation position thereof is above the waterline WL. The pump housing 45 can easily be taken off by removing only the side cover 15 and unscrewing the pump fixing bolt 47. Thus, the impeller 68 can be replaced in an incredibly short amount of time, and the maintainability of the impeller 68 at the time of the replacement can be dramatically improved.

Second Preferred Embodiment

Figure 7:
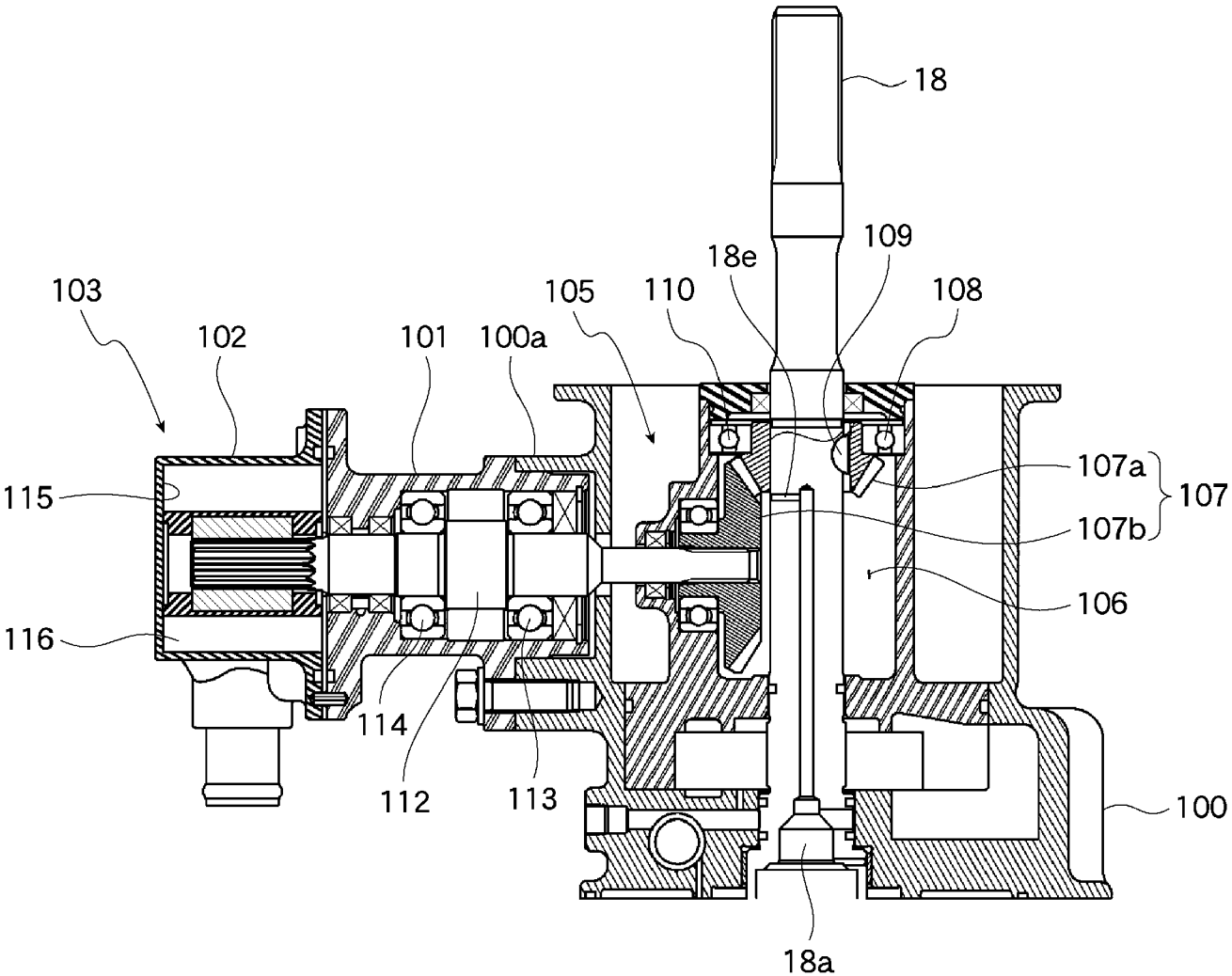
FIG. 7 is a vertical sectional view showing a second preferred embodiment of the present invention.

Next, a second preferred embodiment of the present invention will hereinafter be described with respect to FIG. 7.

In this preferred embodiment, a pump housing 102 is fixed via a shaft housing 101 to an extension 100*a* that is integrally formed with a right side surface of a pump mounting case 100 (corresponding to the pump mounting case 42 in the first preferred embodiment). The shaft housing 101 and the pump housing 102 define an outer shell of the water pump 103.

The water pump 103 is driven by the rotation of the drive shaft 18 that is decelerated and then transmitted to the water pump 103 by a pump drive mechanism 105 using a bevel gear mechanism. The pump drive mechanism 105 is configured as described below.

A pump power takeoff chamber 106 is defined in the pump mounting case 100 and houses a bevel gear mechanism 107. The bevel gear mechanism 107 includes a drive bevel gear 107*a* and a driven bevel gear 107*b*. The drive bevel gear 107*a* is rotatably supported in a pump mounting case 100 by a bearing 108 so as to rotate as a unit with the drive shaft 18 by a woodruff key 109. The driven bevel gear 107*b* is rotatably supported by a bearing 110 and meshes with the drive bevel gear 107*a*. A gear ratio of the drive bevel gear 107*a* to the driven bevel gear 107*b* is set at approximately 1:1.5 to approximately 1:2.

Also, an impeller shaft 112 that projects in a width direction of the motor body extends from the extension 100*a* to the inside of the shaft housing 101, and is pivotally supported by a pair of bearings 113, 114 that is provided in the shaft housing 101.

One end of the impeller shaft 112 is coupled to the driven bevel gear 107*b* for unitary rotation therewith. The other end of the impeller shaft 112 eccentrically penetrates the inside of an impeller chamber 115 that is defined in the shaft housing 101, and is provided with an impeller 116 at a free end for unitary rotation therewith such as by spline-fitting. The arrangement, replacement procedure, and the like of the impeller 116 are the same as those of the impeller 68 in the first preferred embodiment.

The pump drive mechanism 105 includes the bevel gear mechanism 107 and the impeller shaft 112. When the engine 5 of the outboard motor 1 is activated, the rotation of the drive shaft 18 is appropriately decelerated by the bevel gear mechanism 107 with the gear ratio at approximately 1:1.5 to approximately 1:2, and is transmitted to the impeller shaft 112 to rotate the impeller 116.

A main oil passage 18*a* is arranged along the axis of the drive shaft 18. An oil ejection passage 18*e* is arranged to extend in a radial direction of the drive shaft 18 from the proximity of the upper end of the main oil passage 18*a*. The height of the oil ejection passage 18*e* matches the height of a meshing portion of the drive bevel gear 107*a* with the driven bevel gear 107*b* of the bevel gear mechanism 107.

Oil for lubricating the transmission 26 is transferred to the main oil passage 18*a* with pressure. The oil is ejected from the oil ejection passage 18*e* and disseminated to the meshing portion of the drive bevel gear 107*a* with the driven bevel gear 107*b* to lubricate the bevel gear mechanism 107. Here, the main oil passage 18*a* and the oil ejection passage 18*e* define an oil supply device.

According to the above configuration, the rotation of the drive shaft 18 can be transferred in a direction perpendicular or substantially perpendicular to the axial direction of the drive shaft 18 only by the bevel gear mechanism 107 of the pump drive mechanism 105. The rotational speed of the drive shaft 18 can also be decelerated to the optimum value. Thus, it is possible to improve and further decrease the size of the layout around the water pump 103 and the pump drive mechanism 105.

Third Preferred Embodiment

Figure 8:
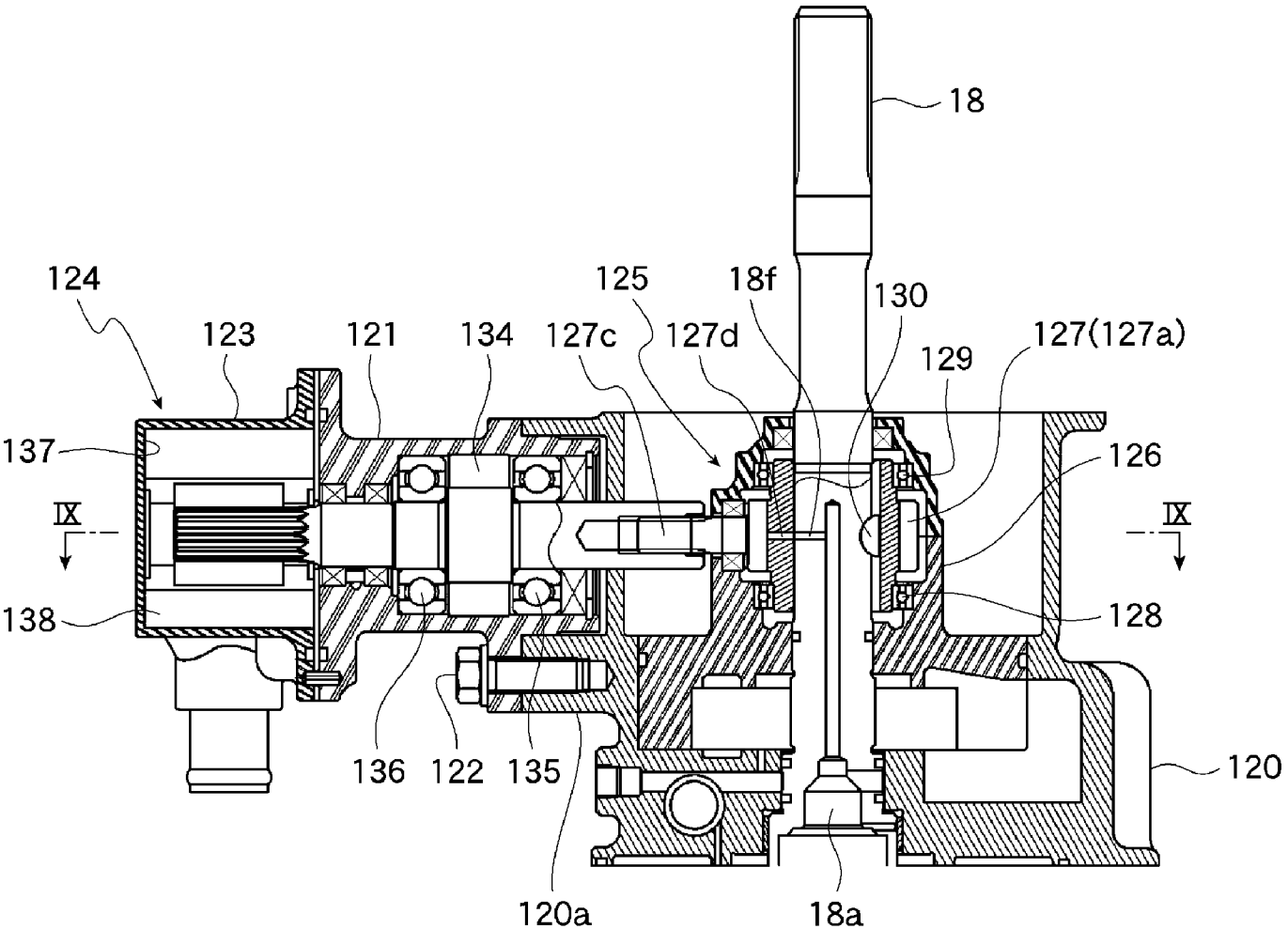
FIG. 8 is a vertical sectional view showing a third preferred embodiment of the present invention.
Figure 9:
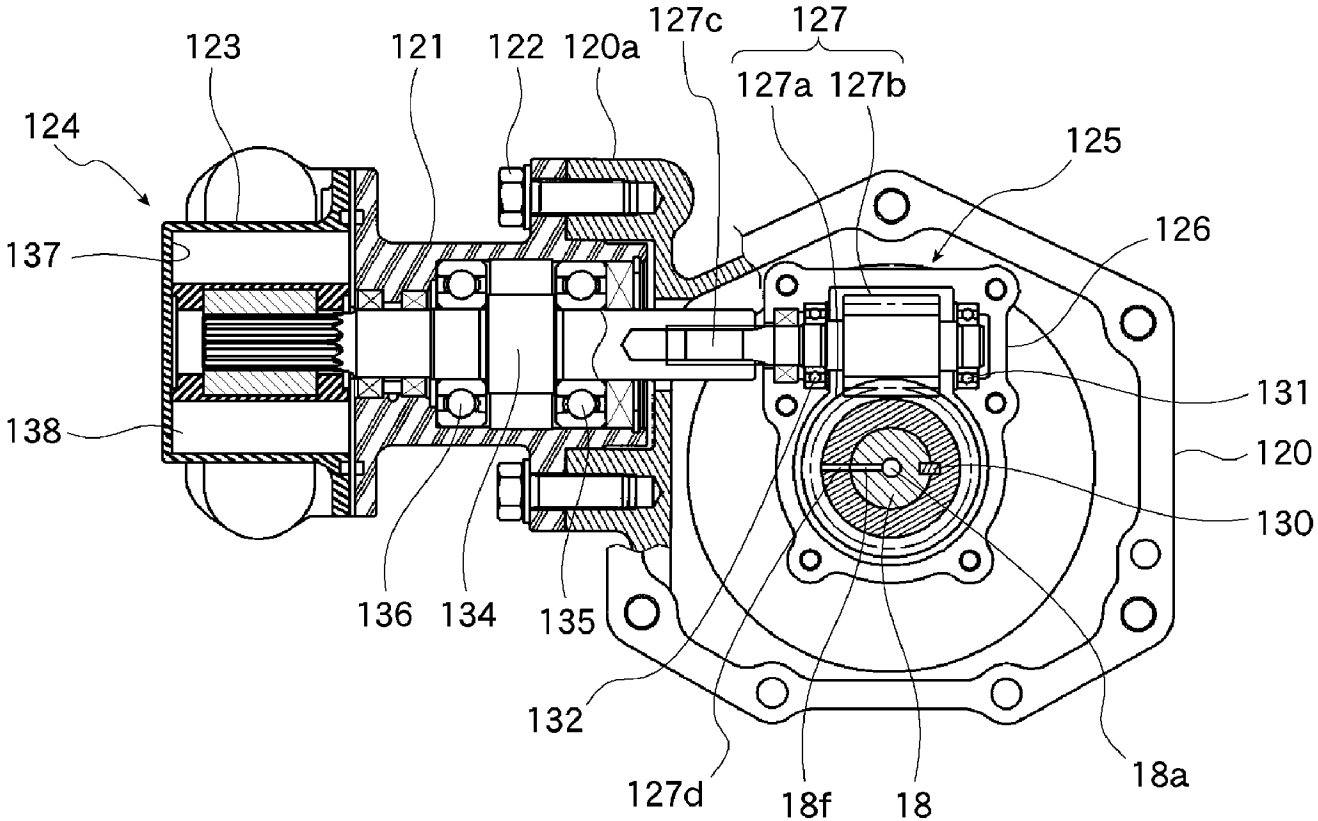
FIG. 9 is a cross-sectional view taken along the line IX-IX in FIG. 8.

Next, a third preferred embodiment of the present invention will hereinafter be described with respect to FIGS. 8 and 9.

In this preferred embodiment, a shaft housing 121 is fixed with a bolt 122 to an extension 120*a* that is integrally formed with a right side surface of a pump mounting case 120. A pump housing 123 is further fixed to an end of the shaft housing 121. The shaft housing 121 and a pump housing 123 define an outer shell of the water pump 124.

The water pump 124 is driven by the rotation of the drive shaft 18 that is decelerated and then transmitted to the water pump 124 by a pump drive mechanism 125 using a screw gear mechanism. The pump drive mechanism 125 is configured as described below.

A gearbox 126 is arranged in the pump mounting case 120 and houses a screw gear mechanism 127. The screw gear mechanism 127 includes a drive screw gear 127*a* and a driven screw gear 127*b*. The drive screw gear 127*a* is rotatably supported by bearings 128, 129 for unitary rotation with the drive shaft 18 by a woodruff key 130. The driven screw gear 127*b* is rotatably supported by bearings 131, 132 and meshes with the drive screw gear 127*a*. A gear ratio of the drive screw gear 127*a* to the driven screw gear 127*b* is set at approximately 1:1.5 to approximately 1:2. An intersecting angle between the gears 127*a*, 127*b* is set at about 90 degrees, for example.

Also, an impeller shaft 134 that follows the width direction of the motor body extends from the extension 120*a* to the inside of the shaft housing 121, and is pivotally supported by a pair of bearings 135, 136 that is provided in the shaft housing 121. The impeller shaft 134, at its left end, is coupled to a center shaft 127*c* such as by spline-fitting to rotate with the driven screw gear 127*b*. The center shaft 127*c* extends from the driven screw gear 127*b* and projects from a right side surface of the gearbox 126 in the width direction of the motor body.

A right end of the impeller shaft 134 eccentrically penetrates the inside of an impeller chamber 137 defined in the pump housing 123, and is provided with an impeller 138 at a free end for unitary rotation side therewith such as by spline-fitting.

The pump drive mechanism 125 is defined by the screw gear mechanism 127 and the impeller shaft 134. When the engine 5 of the outboard motor 1 is started, the rotation of the drive shaft 18 is decelerated by the screw gear mechanism 127 with a gear ratio set at approximately 1:2, and is transmitted to the impeller shaft 134 to rotate the impeller 138.

In addition, the main oil passage 18*a* is arranged along the axis of the drive shaft 18. An oil ejection passage 18*f* extends in the radial direction of the drive shaft 18 from the proximity of the upper end of the main oil passage 18*a*. The oil ejection passage 18*f* is located as high as an oil ejection hole 127*d* that is provided at the center of the drive screw gear 127*a* in the width direction. While the engine 5 is running, oil ejected from the oil ejection hole 127*d* is disseminated to a meshing portion of the drive screw gear 127*a* with the driven screw gear 127*b* to lubricate the screw gear mechanism 127. The main oil passage 18*a*, the oil ejection passage 18*f*, and the oil ejection hole 127*d* define an oil supply device.

In this configuration, the rotation of the drive shaft 18 can be taken in the direction perpendicular or substantially perpendicular to the axial direction of the drive shaft 18 (a horizontal direction) and be decelerated to the optimum value only by the screw gear mechanism 127 of the pump drive mechanism 125. Thus, it is possible to downsize and improve the layout of the pump drive mechanism 125, the water pump 124, and their surroundings.

Also, the intersecting angle between the drive screw gear 127*a* and the driven screw gear 127*b* of the screw gear mechanism 127 can be easily set at an angle other than 90 degrees, and this increases freedom in the installation position of the water pump 124.

As an analogous mechanism to the screw gear mechanism 127, a worm gear mechanism can be used, for example.

Fourth Preferred Embodiment

Figure 10:
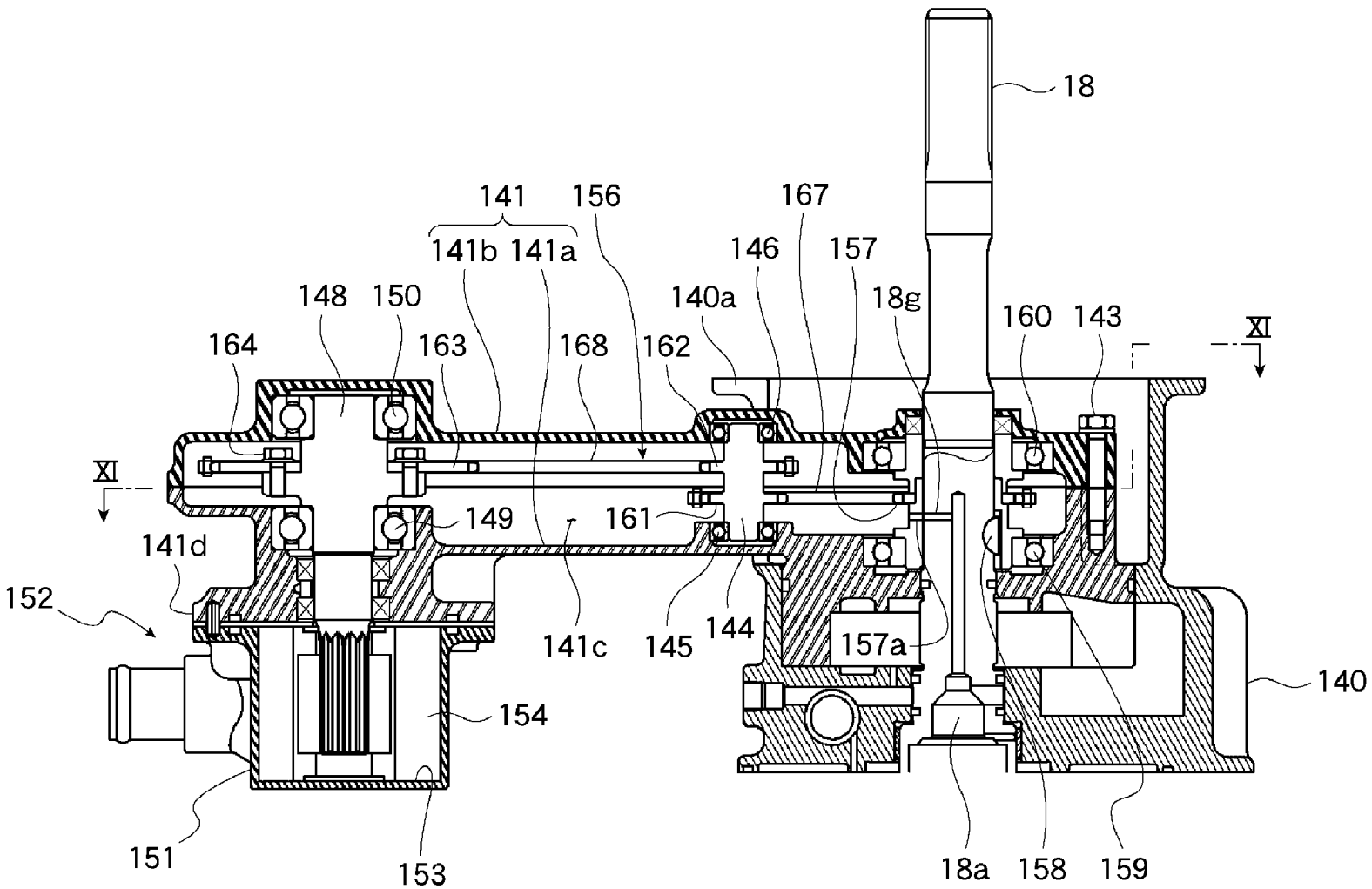
FIG. 10 is a vertical sectional view showing a fourth preferred embodiment of the present invention.
Figure 11:
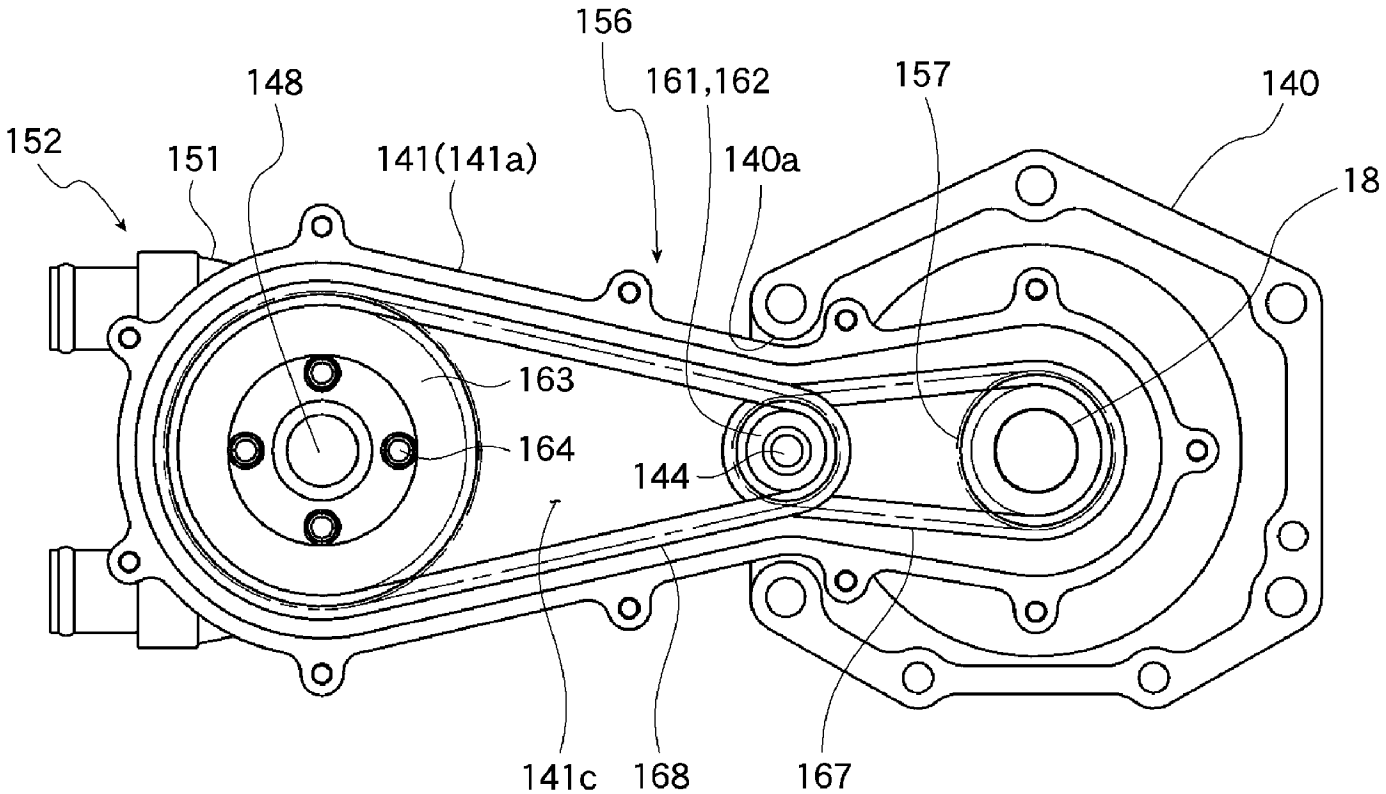
FIG. 11 is a plan view taken along the line XI-XI in FIG. 10.

Next, a fourth preferred embodiment of the present invention will hereinafter be described with respect to FIGS. 10 and 11.

Here, a chain case 141 is mounted to a pump mounting case 140 and projects from a notch 140*a*, which is provided on a right side surface of the pump mounting case 140, to the right in the width direction of the motor body.

The chain case 141 has a configuration in which a lower chain case 141*a* and an upper chain case 141*b* are vertically fit together so that a water-tight chain chamber 141*c* is defined inside. A base of the chain case 141 is fixed to the pump mounting case 140 with a plurality of bolts 143, and the drive shaft 18 extends therethrough.

A midsection of the chain case 141 is tightly constricted in a plan view (see FIG. 11) and passes the notch 140*a* of the pump mounting case 140. In this section, an idler shaft 144 that is parallel or substantially parallel with the drive shaft 18 is pivotally supported by bearings 145, 146.

A tip of the chain case 141 is wider than the base and the midsection thereof. An impeller shaft 148 that is parallel or substantially parallel with the drive shaft 18 is pivotally supported by bearings 149, 150 at the tip of the chain case 141.

A mounting flange 141*d* is provided on a lower surface at the tip of the chain case 141, and a pump housing 151 is fixed thereto in a water-tight manner. The tip of the chain case 141 and the pump housing 151 define an outer shell of a water pump 152.

A lower end of the impeller shaft 148 eccentrically penetrates the inside of an impeller chamber 153 arranged in the pump housing 151, and is provided with an impeller 154 at a free end (a lower side) for unitary rotation therewith such as by spline-fitting.

The water pump 152 is driven by the rotation of the drive shaft 18 that is decelerated by a pump drive mechanism 156 provided in a chain chamber 141*c* in the chain case 141 and then transmitted to the water pump 152. The pump drive mechanism 156 is a chain drive mechanism and is configured as described below.

In the chain chamber 141*c*, a primary drive sprocket 157 is provided on the drive shaft 18 for unitary rotation by a woodruff key 158, and is supported by the chain case 141 through bearings 159, 160.

In addition, a primary driven sprocket 161 and a secondary drive sprocket 162 are integrally provided on the aforementioned idler shaft 144. The secondary driven sprocket 163 is fastened to the impeller shaft 148 by a bolt 164. Then, a primary chain 167 is wound around the primary drive sprocket 157 and the primary driven sprocket 161. A secondary chain 168 is wound around the second drive sprocket 162 and the secondary driven sprocket 163.

The primary drive sprocket 157 has a greater number of teeth than the primary driven sprocket 161, and the primary driven sprocket 161 has the same number of teeth as the second drive sprocket 162. The second driven sprocket 163 has a greater number of teeth than the other sprockets 157, 161, 162. The number of teeth of each sprocket 157, 161, 162, 163 is set so that the rotational speed of the drive shaft 18 is reduced to a predetermined ratio and then transmitted to the impeller shaft 148 (for example, a reduction ratio of approximately 1/1.5 to approximately 1/2).

The pump drive mechanism 156 is defined by the idler shaft 144, the primary drive sprocket 157, the primary driven sprocket 161, the secondary drive sprocket 162, the secondary driven sprocket 163, the primary chain 167, and the secondary chain 168.

When the engine 5 of the outboard motor 1 is started, the rotational speed of the drive shaft 18 is appropriately reduced by the pump drive mechanism 156 and then transmitted to the impeller shaft 148 to rotate the impeller 154.

The main oil passage 18*a* is arranged along the axis of the drive shaft 18. An oil ejection passage 18*g* extends in the radial direction of the drive shaft 18 from the proximity of the upper end of the main oil passage 18*a*. The oil ejection passage 18*g* is located as high as an oil ejection hole 157*a* that is provided in the primary drive sprocket 157. While the engine 5 is running, oil ejected from the oil ejection hole 157*a* is disseminated to each sprocket 157, 161, 162, 163 as well as each chain 167, 168 for lubrication thereof. The main oil passage 18*a*, the oil ejection passage 18*g*, and the oil ejection hole 157*a* define an oil supply device.

With the above configuration, by virtue of the chain drive mechanism, the height dimension of the pump drive mechanism 156 becomes small as compared with a case where a bevel gear or the like is utilized. Thus, it is possible to reduce the height dimension of the pump mounting case 140.

The pump drive mechanism 156 is the chain drive mechanism in which the rotation of the drive shaft 18 is divided into two stages by the four sprockets 157, 161, 162, 163 as well as by the two chains 167, 168 and then transmitted to the impeller shaft 148. Also, the sprockets 162, 163 that are located in the middle of the pump drive mechanism 156 have a smaller number of teeth than the sprockets 157, 163. Thus, it is possible to narrow the width of the midsection of the chain case 141. Accordingly, it is possible to minimize the decrease in strength when reducing the area of the notch 140*a* of the pump mounting case 140 and the opening area of the pump opening 2*c* of the upper casing 2 (see FIG. 3).

In the abovementioned first to fourth preferred embodiments, the water pump 41 is preferably completely exposed to the outside of the casing 12. However, it does not have to be exposed to the outside of the casing 12. For example, the water pump 41 may be provided in the casing 12, and the cooling water intake section 71 and the cooling water discharge section 72 may be built into the casing 12. Alternatively, a configuration may be used in which only the cooling water intake section 71 and the cooling water discharge section 72 of the water pump 41 are open to the outside of the casing 12 and in which the intake conduit member 82 and the discharge conduit member 83 are disposed outside the casing 12.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine including a vertically-positioned crankshaft, the engine mounted above a casing;

a drive shaft arranged to transmit a rotation of the crankshaft to a propeller shaft pivotally supported in a lower portion of the casing;

a bevel gear mechanism arranged between the drive shaft and the propeller shaft to transmit a rotation of the drive shaft to the propeller shaft;

a transmission mounted on the drive shaft, the transmission arranged to reduce a rotational speed of the drive shaft via a reduction mechanism and/or to reverse a direction of the rotation of the drive shaft, the transmission being arranged between the engine and the bevel gear mechanism;

a pump arranged to draw in cooling fluid; and a pump drive mechanism arranged to transmit the rotation of the drive shaft to the pump; wherein the pump drive mechanism is arranged between the engine and the transmission.

2. The outboard motor according to claim 1, wherein the pump drive mechanism is arranged to transmit power from a generally axial direction of the drive shaft to a generally radial direction of the drive shaft in order to drive the pump.

3. The outboard motor according to claim 1, wherein the pump drive mechanism is arranged adjacent the transmission mounted on the drive shaft, and the pump drive mechanism is provided with an oil supply device arranged to supply a portion of a transmission lubricating oil to the pump drive mechanism.

4. The outboard motor according to claim 3, wherein the oil supply device is arranged to supply the transmission lubricating oil to every lubricated section of the pump drive mechanism through an oil passage arranged along an axis of the drive shaft.

5. The outboard motor according to claim 1, wherein the pump drive mechanism is arranged to reduce the rotational speed of the drive shaft through a spur gear mechanism and to transmit the reduced rotational speed to the pump.

6. The outboard motor according to claim 1, wherein the pump drive mechanism is arranged to reduce the rotational speed of the drive shaft through a second bevel gear mechanism and to transmit the reduced rotational speed to the pump.

7. The outboard motor according to claim 1, wherein the pump drive mechanism is arranged to reduce the rotational speed of the drive shaft through a screw gear mechanism and to transmit the reduced rotational speed to the pump.

8. The outboard motor according claim 1, wherein the pump drive mechanism is arranged to reduce the rotational speed of the drive shaft through a chain drive mechanism and to transmit the reduced rotational speed to the pump.

9. The outboard motor according to claim 1, wherein the pump drive mechanism is arranged to transmit the rotation of the drive shaft to the pump through a plurality of power transmission mechanisms.

10. The outboard motor according to claim 1, wherein the pump drive mechanism is arranged to reduce a rotational speed of the drive shaft through a reduction mechanism and to transmit the reduced rotational speed to the pump.

* * * * *